United States Patent [19]

Hilton

[11] 4,080,605

[45] Mar. 21, 1978

[54] MULTI-BEAM RADIO FREQUENCY ARRAY ANTENNA

[75] Inventor: Richard F. Hilton, Goleta, Calif.

[73] Assignee: Raytheon Company, Lexington, Mass.

[21] Appl. No.: 717,951

[22] Filed: Aug. 26, 1976

[51] Int. Cl.[2] ..... H01Q 3/26

[52] U.S. Cl. ..... 343/854; 343/754

[58] Field of Search ..... 343/754, 854, 100 LE, 343/853, 876

[56] References Cited

U.S. PATENT DOCUMENTS

| | | | |
|---|---|---|---|
| 3,295,134 | 12/1966 | Lowe | 343/854 |
| 3,653,057 | 3/1972 | Charlton | 343/854 |
| 3,979,754 | 9/1976 | Archer | 343/754 |

*Primary Examiner*—Eli Lieberman

*Attorney, Agent, or Firm*—Richard M. Sharkansky; Joseph D. Pannone

[57] ABSTRACT

An array antenna having a plurality of radiating elements coupled to a first plurality of radio frequency lenses, such first plurality of radio frequency lenses being coupled to receiving or transmitting apparatus through a second plurality of radio frequency lenses. With such an arrangement, sidelobes associated with any one of the radio frequency lenses in the first plurality thereof are reduced by the focusing effect of the second plurality of radio frequency lenses.

1 Claim, 2 Drawing Figures

MULTI-BEAM RADIO FREQUENCY ARRAY ANTENNA

BACKGROUND OF THE INVENTION

This invention relates generally to radio frequency array antennas and more particularly to radio frequency array antennas adapted to form a plurality of simultaneously existing beams of radio frequency energy.

It is known in the art that a radio frequency array antenna may be arranged to produce a plurality of simultaneously existing beams of radio frequency energy. If such an array antenna is properly designed, each one of the beams has the gain and bandwidth of the entire antenna aperture. According to the art, a desired number of simultaneous beams may be obtained by connecting each antenna element in the array through a different constrained electrical path to a plurality of feed ports, the constrained electrical path being made up of an electromagnetic lens which equalizes the time delay of the electromagnetic energy between any given one of a number of feed ports and all points on corresponding planar wavefronts of either transmitted or received energy. One such antenna is described in U.S. Pat. No. 3,761,936, "Multi-Beam Array Antenna," inventors D. H. Archer et al, issued Sept. 25, 1973 and assigned to the same assignee as the present invention.

While such array antenna has been found quite satisfactory in many applications, it is sometimes necessary that such array antenna have sidelobes lower than those obtainable with a single electromagnetic lens. While such sidelobes are theoretically achievable by tapering the field amplitude across the array aperture, such levels are seldom achieved due to deviations in the aperture field amplitude and phase from the theoretically designed values. Such deviations are generally attributable to such things as mutual array element coupling and reflections within the electromagnetic lens. Conceptually, one method which might be used to correct the amplitude and phase deviations is through the insertion of a variable attenuator and phase shifter serially with each one of the array elements, such attenuators and phase shifters being adjusted to achieve the proper aperture distribution. However, the use of such arrangement would provide proper adjustment for only one beam at only a single frequency.

SUMMARY OF THE INVENTION

With this background of the invention in mind it is therefore an object of this invention to provide an improved multibeam array antenna having improved sidelobe characteristics over a relatively wide frequency bandwidth.

This and other objects of the invention are attained generally by providing an array antenna having: a plurality of spatially overlapping sets of N radiating elements; a like plurality of radio frequency lenses, each one having N input ports coupled to different ones of the N radiating elements in a corresponding one of the sets thereof, and a plurality of output ports; a second plurality of radio frequency lenses, each one having: a plurality of input ports coupled to a corresponding one of the output ports of a different one of the first plurality of radio frequency lenses; and, an output port, the electrical length from the output port of one of such second plurality of radio frequency lenses through the first plurality of radio frequency lenses and the radiating elements coupled thereto to all points on a corresponding wavefront being substantially equal.

With such an arrangement, sidelobes associated with any one of the radio frequency lenses in the first plurality thereof are reduced by the focusing effect of the second plurality of radio frequency lenses coupled thereto.

BRIEF DESCRIPTION OF THE DRAWINGS

The above-mentioned and other features of the invention will become more apparent by reference to the following description taken together in conjunction with the accompanying drawings, in which.

DESCRIPTION OF THE PREFERRED EMBODIMENTS

Figure 1:
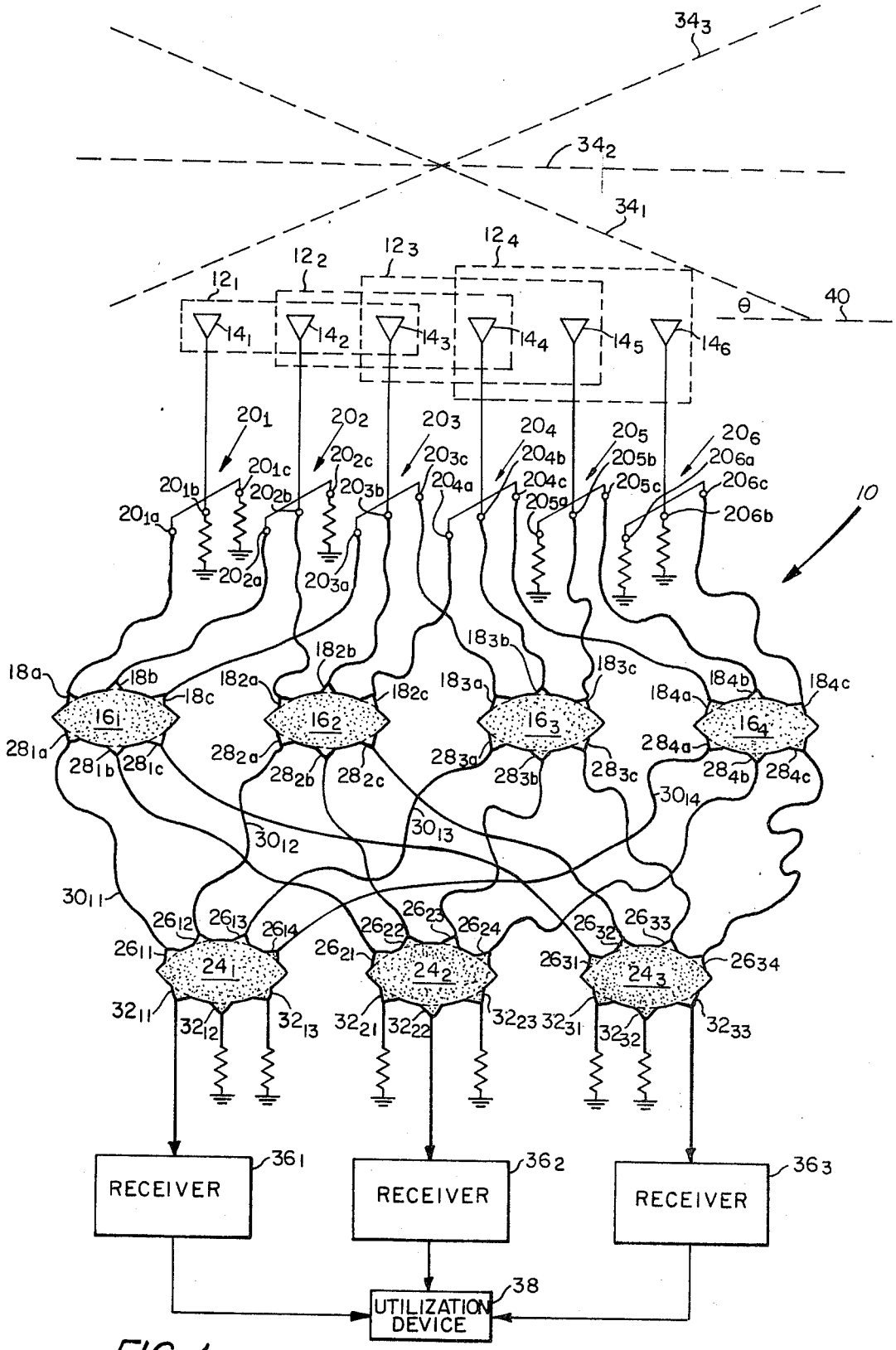
FIG. 1 is a block diagram of a radio frequency array antenna system according to the invention.

Referring now to FIG. 1, a multibeam array antenna 10 is shown to include a plurality of, here four, spatially overlapping sets $12_1$–$12_4$ of radiating elements $14_1$–$14_6$. It should be noted that six radiating elements have been arranged in four sets for simplicity and it should be recognized that many more radiating elements and overlapping sets thereof will generally be used. Therefore, in the more general case when 2N radiating elements are used in the array, such 2N radiating elements are grouped in N+1 spatially overlapping sets. Each one of the sets $12_1$–$12_4$ of radiating elements is coupled to a corresponding one of a like plurality of radio frequency lenses $16_1$–$16_4$. Such radio frequency lens is described in the above referenced U.S. Pat. No. 3,761,936. Therefore, radio frequency lens $16_1$ is coupled to set $12_1$ (i.e. radiating elements $14_1$–$14_3$), radio frequency lens $16_2$ is coupled to set $12_2$ (i.e. radiating elements $14_2$–$14_4$), radio frequency lens $16_3$ is coupled to set $12_3$ (i.e. radiating elements $14_3$–$14_5$) and radio frequency lens $16_4$ is coupled to set $12_4$ (i.e. radiating elements $14_4$–$14_6$), as shown. More specifically, radio frequency lenses $16_1$–$16_4$ have here three input ports, $18_{1a}$, $18_{1b}$, $18_{1c}$ . . . $18_{4a}$, $18_{4b}$, $18_{4c}$, respectively, as shown. The input ports are coupled via constrained electrical paths, here provided by coaxial cables (not numbered), to the radiating elements $14_1$–$14_6$ via 3:1 power dividers $20_1$–$20_6$. Each one of the power dividers has three output ports, $20_{1a}$, $20_{1b}$, $20_{1c}$ . . . $20_{6a}$, $20_{6b}$, $20_{6c}$. Port $20_{1a}$ is coupled to input port $18_{1a}$, ports $20_{1b}$ and $20_{1c}$ being terminated to ground through a suitable load, not numbered. The ports $20_{2a}$, $20_{2b}$ and $20_{2c}$ of power divider $20_2$ are coupled in input ports $18_{1b}$, $18_{2a}$, and to ground through a suitable terminating load, respectively, as shown. Output ports $20_{3a}$, $20_{3b}$ and $20_{3c}$ of power divider $20_3$ are coupled to input ports $18_{1c}$, $18_{2b}$ and $18_{3a}$, respectively. Ports $20_{4a}$, $20_{4b}$ and $20_{4c}$ of power divider $20_4$ are coupled to input ports $18_{2c}$, $18_{3b}$, $18_{4a}$, respectively, as shown. Ports $20_{5a}$, $20_{5b}$ and $20_{5c}$ of power divider $20_5$ are coupled to ground through a suitable load, input port $18_{3c}$ and input port $18_{4b}$, respectively, as shown. Output ports $20_{6a}$, $20_{6b}$ of power divider $20_6$ are coupled to ground through suitable loads and output port $20_{6c}$ is coupled to input port $18_{4c}$, as shown.

It should be noted that, in the general case, when 2N radiating elements are grouped in N+1 overlapping sets, each one of the N+1 radio frequency lenses will have N input ports.

A second plurality, here three, of radio frequency lenses $24_1$, $24_2$, $24_3$ are coupled to the first set of radio frequency lenses $16_1$, $16_2$, $16_3$, $16_4$. It should be noted that the number of radio frequency lenses in the second plurality thereof is here chosen as three for simplicity and the number of radio frequency lenses is equal to the number of independent simultaneous beams to be formed by the array antenna 10 and that in general case the number of radio frequency lenses in the second set thereof will generally be greater than three. Each one of such radio frequency lenses $24_1$, $24_2$, $24_3$ includes a number of input ports equal to the number of lenses in the first set thereof; hence, each one of such radio frequency lenses has four input ports, $26_{11}$, $26_{12}$, $26_{13}$, $26_{14}$ . . . $26_{31}$, $26_{32}$, $26_{33}$, $26_{34}$. Each one of the four input ports of each one of the radio frequency lenses in the second plurality thereof is coupled to an output port of a different one of the radio frequency lenses $16_1$–$16_4$ in the first plurality thereof through constrained electrical paths, here through coaxial cables. More specifically, input ports $26_{11}$, $26_{12}$, $26_{13}$, $26_{14}$ are coupled to output ports $28_{1a}$, $28_{2a}$, $28_{3a}$ and $28_{4a}$ of radio frequency lenses $16_1$, $16_2$, $16_3$, $16_4$, respectively, through coaxial cables $30_{11}$, $30_{12}$, $30_{13}$, $30_{14}$. Similarly, input ports $26_{21}$, $26_{22}$, $26_{23}$, $26_{24}$ are coupled to output ports $28_{1b}$, $28_{2b}$, $28_{3b}$ and $28_{4b}$ of radio frequency lenses $16_1$, $16_2$, $16_3$, $16_4$ through coaxial cables (not numbered). Likewise, input ports $26_{31}$, $26_{32}$, $26_{33}$, $26_{34}$ of radio frequency lens $24_3$ are coupled to output ports $28_{1c}$, $28_{2c}$, $28_{3c}$, $28_{4c}$ of radio frequency lenses $16_1$, $16_2$, $16_3$, $16_4$ respectively through coaxial cables not numbered. Each one of the radio frequency lenses $24_1$–$24_3$ has an output port $32_{11}$, $32_{22}$, $32_{33}$ respectively, as shown. Output ports $32_{11}$, $32_{22}$, $32_{33}$ are connected to receivers $36_1$, $36_2$, and $36_3$, respectively, as shown. The outputs of receivers $36_1$–$36_3$ are fed to a utilization device 38 which detects which one or ones of such receivers $36_1$–$36_3$ are receiving radio frequency energy. One such arrangement is shown and described in the above referenced U.S. Pat. No. 3,761,936. It is here noted that the radio frequency lenses $16_1$–$16_4$, $24_1$–$24_3$, the interconnecting coaxial cables and the power dividers $20_1$–$20_6$ are arranged such that the electrical lengths from output port $32_{11}$ of radio frequency lens $24_1$ to all points on wavefront $34_1$ are equal. Likewise, the electrical lengths from output port $32_{22}$ of radio frequency lens $24_2$ to all points on wavefront $34_2$ are equal and the electrical lengths from output port $32_{33}$ of radio frequency lens $24_3$ to all points on wavefront $34_3$ are equal. It is also noted that output ports $32_{12}$, $32_{13}$, $32_{21}$, $32_{23}$, $32_{31}$, $32_{33}$ are coupled to ground through suitable loads (not numbered), as shown.

In order to understand the operation of the array antenna consider wavefront $34_1$. The electrical lengths between port $28_{1a}$ and all points on wavefront $34_1$ are equal, the electrical lengths between port $28_{2a}$ and all points on wavefront $34_1$ are equal, the electrical lengths between port $28_{3a}$ and all points on wavefront $34_1$ are equal and the electrical lengths between port $28_{4a}$ and all points on wavefront $34_1$ are equal. A portion of the radio frequency energy is received by the antenna elements $14_1$–$14_3$. One third of energy in set $12_1$ therefore is coupled through each one of such antenna elements $14_1$–$14_3$ to radio frequency lens $16_1$ the energy arriving at port $28_{1a}$ "in phase" and the energy arriving at ports $28_{1b}$ and $28_{1c}$ "out of phase." That is, the vectorial addition of the "in phase" energy results in a maximum composite signal at port $28_{1a}$ and the vectorial addition of the "out of phase" energy results in composite signals at ports $28_{1b}$, $28_{1c}$ which are substantially less, say on the order of 14 db down from the maximum composite signal. This effect is described in the above referenced U.S. Pat. No. 3,761,936 and also U.S. Pat. No. 3,715,749, "Multi-Beam Radio Frequency System" inventors Archer et al issued Feb. 6, 1973 and assigned to the same assignee as the present invention. Likewise, the radio frequency energy associated with wavefront $34_1$ and received by the antenna elements $14_2$–$14_4$ in the set $12_2$ arrive "in phase" at port $28_{2a}$ and arrive "out of phase" at ports $28_{2b}$ and $28_{2c}$. Continuing: the radio frequency energy associated with wavefront $34_1$ and received by antenna elements $14_3$–$14_5$ in set $12_3$ arrive "in phase" at port $28_{3a}$; and "out of phase" at ports $28_{3b}$ and $28_{3c}$; and the radio frequency energy associated with wavefront $34_1$ and received by antenna elements $14_4$–$14_6$ in set $12_4$ arrive "in phase" at ports $28_{4a}$ and "out of phase" at ports $28_{4b}$ and $28_{4c}$. The power dividers $20_1$–$20_6$ enable the "in phase" signals at ports $28_{1a}$, $28_{2a}$, $28_{3a}$ and $28_{4a}$ to be of equal level. However, because such wavefront $34_1$ is at an angle $\theta$ with respect to the face of the array, such face being represented by the dotted line 40, the "in phase" signals at such ports $28_{1a}$, $28_{2a}$, $28_{3a}$, $28_{4a}$ differ in phase from one another by an amount related to the sin $\theta$. The signals at ports $28_{1a}$, $28_{2a}$, $28_{3a}$, $28_{4a}$ with this relative phase difference are applied to ports $26_{11}$, $26_{12}$, $26_{13}$, $26_{14}$ of lens $24_1$ and arrive "in phase" at port $32_{11}$ of lens $24_1$. The signals at ports $28_{1b}$, $28_{2b}$, $28_{3b}$, $28_{4b}$, having been reduced, here −14db, by lenses $16_1$–$16_4$, for reasons discusses above, arrive "out of phase" at port $32_{22}$ and therefore lens $24_2$ further reduces the sidelobes of wavefront $34_1$, here an additional −14db. Likewise, the signals at ports $28_{1c}$, $28_{2c}$, $28_{3c}$, $28_{4c}$, having been reduced, here −14db, by lenses $16_1$–$16_4$, for reasons discusses above, arrive "out of phase" at port $32_{33}$ and therefore lens $24_3$ further reduces the sidelobes of wavefront $34_1$, here an additional −14db. The effect of lenses $24_1$–$24_3$ then is to reduce the "effective sidelobes" of lenses $16_1$–$16_4$, here by −14db, therefore the sidelobe characteristics of the entire array antenna 10 is here −28db.

Likewise, for wavefront $34_2$, the energy associated therewith adds "in phase" at port $32_{22}$. Lenses $16_1$–$16_4$ reduce the sidelobes associated therewith −14db and lenses $24_1$, $24_3$ provide an additional −14db reduction so that a −28db sidelobe reduction is achieved by the array antenna 10. A similar situation results with respect to wavefront $34_3$, that is the energy associated therewith adds "in phase" at port $32_{33}$. Lenses $16_1$–$16_4$ reduce the sidelobes associated therewith −14db and lenses $24_1$, $24_2$ provide an additional −14db reduction so that a −28db sidelobe reduction is achieved by the array antenna 10.

Figure 2:
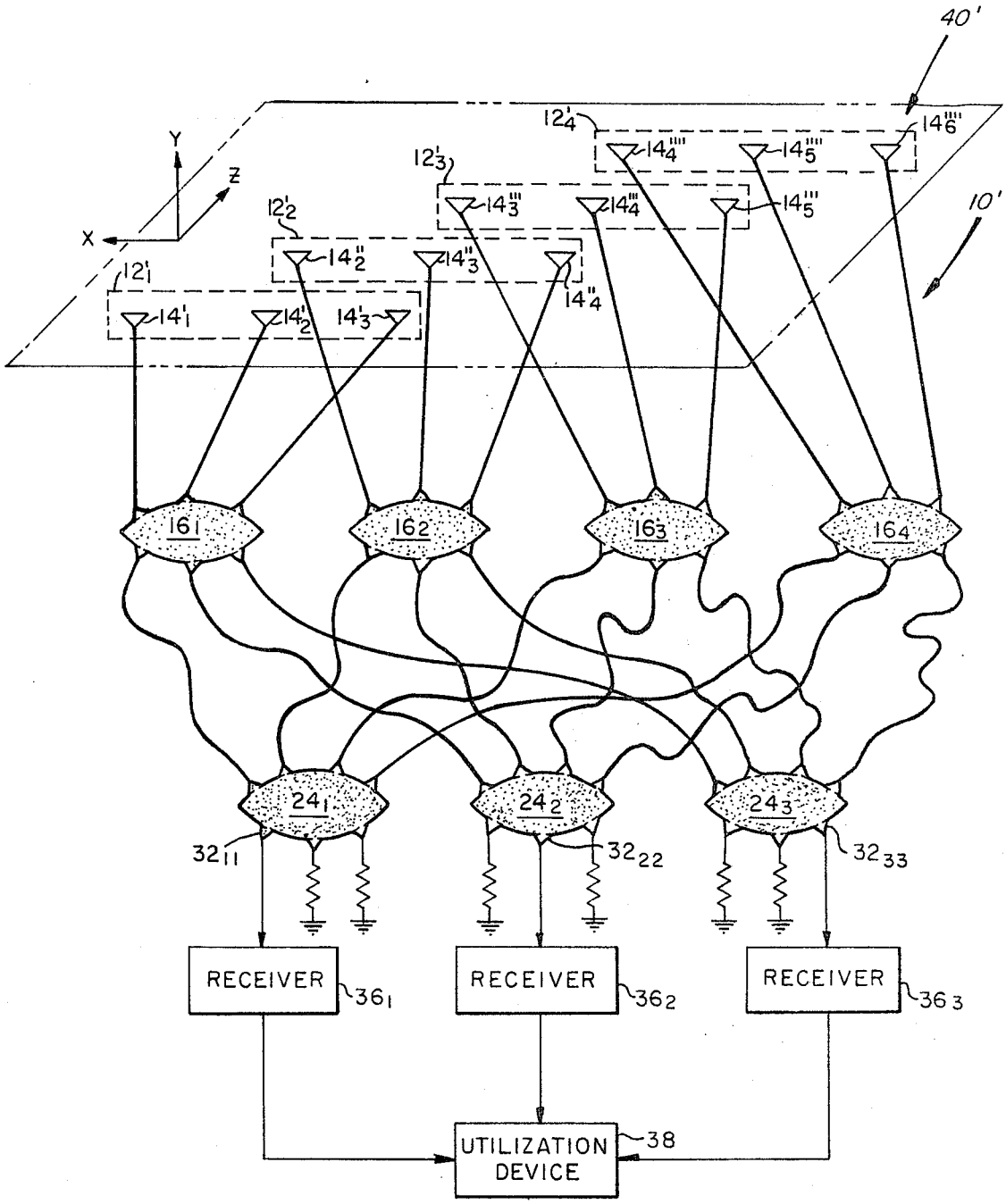
FIG. 2 is a block diagram of an alternative embodiment of a radio frequency array antenna system according to the invention.

Referring now to FIG. 2 array antenna 10' is shown. It is noted that such array antenna 10' is identical to array antenna 10 (FIG. 1) except that the power dividers have been eliminated. In particular, four sets $12_1'$–$12_4'$ of radiating elements are shown. Each one of the four sets $12_1'$–$12_4'$ includes a linear array of, here, three radiating elements, $14_1'$–$14_3'$; $14_2''$–$14_4''$; $14_3'''$–$14_5'''$; and $14_4''''$–$14_6''''$, respectively, as shown. Each linear array of radiating elements is disposed parallel to the X-axis as shown. The sets $12_1'$–$12_4'$ are disposed along the Z-axis, as shown. That is, the face 40' of the array antenna 10' is disposed in the X-Z plane, the Y-axis being orthogonal to the face of the array antenna 10'. It follows then that, looking along the Z-axis, the sets $12_1'$–$12_4'$ may be considered as four overlapping sets of radiating elements. With such an arrangement narrower elevation beamwidths are produced as compared to those produced using the array antenna 10 (FIG. 1) assuming array antennas 10, 10' each have radiating elements with identical characteristics. The elevation angle is defined as the angular deviation of the beam from the Z-axis. In this configuration, i.e., in the array antenna 10', statistical averaging of the aperture field error contributions from the radiating element outputs may be viewed as occurring in free space when considering transmit operation rather than occurring inside the power dividers shown in FIG. 1.

Having described preferred embodiments of the invention, it should now become evident to one of skill in the art that other embodiments incorporating these concepts may be used. For example, the array antenna may be used in a transmitter application, principals of reciprocity applying and therefore may be used in the multi-beam radio frequency system described in the above-referenced U.S. Pat. No. 3,715,749. Further other techniques for reducing sidelobes, such as attentuating the lens outputs, may also be incorporated into the described array antennas to further reduce the overall sidelobe levels of the array antennas. It is felt, therefore, that this invention should not be restricted to the disclosed embodiment but rather should be limited only by the spirit and scope of the appended claims.

What is claimed is:

1. A radio frequency array antenna system adapted to form a plurality of beams of radio frequency energy, each one of such beams being associated with a corresponding wavefront formed across a face of the array antenna system, such system comprising:

a. a linear array of 2N radiating elements arranged in (N+1) sets, where N is an integer, such sets being arranged in successively staggered, partially overlapping relationship across different portions of the wavefront;

b. 2N power dividers for coupling energy between each one of the 2N radiating elements and (N+1) sets of output ports of such power dividers;

c. a first set of radio frequency lenses, each one of such lenses having a plurality of input ports coupled to a corresponding one of the (N+1) sets of output ports of the power dividers and a plurality of output ports, for enabling energy from one of such beams to appear "in phase" at a corresponding one of the output ports of each one of such lenses and sidelobe energy to appear at the remaining ones of the output ports of each one of such lenses; and, d. a second set of radio frequency lenses, each one having an output port and being associated with a corresponding one of the beams, such lenses enabling the "in phase" energy of the corresponding beam to appear "in phase" at the output port of such corresponding one of the second set of lenses and the remaining ones of such second set of lenses enabling the sidelobe energy to appear "out of phase" at the output ports of such remaining ones of such second set of lenses.

* * * * *